United States Patent [19]

Magnani et al.

[11] Patent Number: 4,927,294

[45] Date of Patent: May 22, 1990

[54] METHOD AND EQUIPMENT FOR LAYING AN ELONGATED ELEMENT UNDERGROUND

[75] Inventors: Francesco Magnani, Pavia; Paolo Minardi, Martellago, both of Italy

[73] Assignee: Societa' Cavi Pirelli S.p.A., Milan, Italy

[21] Appl. No.: 339,407

[22] Filed: Apr. 18, 1989

[30] Foreign Application Priority Data

Apr. 22, 1988 [IT] Italy ..... 20292A

[51] Int. Cl.[5] ..... F16L 1/00

[52] U.S. Cl. ..... 405/177; 405/165; 405/174; 405/175; 254/273

[58] Field of Search ..... 405/177, 174, 175, 180, 405/165, 166; 242/86.5 R; 254/273

[56] References Cited

U.S. PATENT DOCUMENTS

| | | | |
|---|---|---|---|
| 3,343,739 | 9/1967 | Kinnan | 405/177 X |
| 3,788,575 | 1/1974 | Boettcher et al. | 405/177 X |
| 4,150,911 | 4/1979 | Droste et al. | 405/177 |
| 4,692,063 | 9/1987 | Conti | 405/177 |
| 4,744,696 | 5/1988 | Vidler | 405/177 X |

FOREIGN PATENT DOCUMENTS

| | | | |
|---|---|---|---|
| 2909662 | 9/1980 | Fed. Rep. of Germany | 405/177 |

*Primary Examiner*—Dennis L. Taylor

*Attorney, Agent, or Firm*—Brooks, Haidt, Haffner & Delahunty

[57] ABSTRACT

In mobile laying apparatus for laying an elongated element, such as a cable, in a trench, especially a trench in a sea bed, which apparatus is advanced in a predetermined direction and includes apparatus for digging the trench and ways along which the element slides as it is deposited in the trench, tension control apparatus and a method for preventing the accumulation of such element upstream of the laying apparatus as the element is laid. In the method, a tension force is applied to the element so that the tension thereon upstream of the laying apparatus is at least equal to the tension on the element downstream of the laying apparatus. The tension control apparatus includes motor driven rollers or tracks at the ways which engage the element. The torque which the driving motors apply or alternatively, the energization of the driving motors and the advance of the laying apparatus is controlled by the position of a portion of the element upstream of the laying apparatus.

20 Claims, 2 Drawing Sheets

METHOD AND EQUIPMENT FOR LAYING AN ELONGATED ELEMENT UNDERGROUND

The present invention relates to a method and an equipment for laying underground an elongated element.

BACKGROUND OF THE INVENTION

It is known that when electric cables, telecommunication cables, flexible hoses or elongated elements in general, are laid underwater, they are laid in appropriate trenches to avoid possible damage. On account of the sea depth, which is sometimes relevant, and of the consequent difficulty for the operators to work at such a depth, the laying of the elongated element is carried out by means of laying machines, remotely controlled by the tender ship, which, while progressively advancing on the sea bed, dig the trench and deposit the elongated element therein.

More particularly, said machines lift the elongated element, cause it to slide along ways thereon, and then lay it on the trench bottom. Because of the high friction generated between the elongated element and the sliding means or ways, the portion of the elongated element situated downstream of the laying machine is subjected to a tension greater than that applied to the portion situated upstream, so that a surplus of elongated element begins to accumulate upstream of the laying machine.

On account of the considerable length of the elongated elements, the accumulated surplus can become detrimental in a short time. In fact, the elongated elements may bend at short bending radii, which may impair them, or even may be trapped under the laying machine, with a high risk of damage to the elements and/or to the laying machine.

To eliminate this disadvantage, some laying machines are provided in their front part with a mechanical moving arm, terminating with a guide into which the elongated element passes. When a surplus of the elongated element accumulates upstream of the laying machine, the mechanical arm is raised, lifting the elongated element and avoiding situations of risk for the element and/or for the laying machine.

Said machines, however, solve the problem only temporarily, since they are unable to transfer the accumulated surplus from upstream to downstream and, therefore, to avoid accumulation during the progressive advancement of the machine.

BRIEF DESCRIPTION OF THE INVENTION

The present invention has, as one object, the overcoming of the described drawbacks of prior art machines and to provide a method and an equipment or apparatus for laying an elongated element underground, which method and equipment are able to prevent the accumulation of surplus element upstream of the laying equipment.

To achieve this object, the present invention provides a method for laying an elongated element into a trench by means of equipment comprising advancing means and ways for said elongated element, characterized in that an active tension acting in the direction opposite to the direction of advancement of the laying equipment is applied on the elongated element, so that the portion of elongated element situated upstream of said equipment is subjected to a tension equal to, or higher than, the tension of the portion of elongated element situated downstream of said equipment.

In a preferred embodiment, the tension of said portion of elongated element situated upstream of the laying equipment is adjusted in a continuous way to keep it at about a pre-established optimum value. In a second preferred embodiment, the upstream tension is, instead, kept within pre-established minimum and maximum values. When it is lower than the pre-established minimum value, the means advancing the laying equipment is stopped, whereas, when it is higher than the pre-established maximum value, the active tension is no longer applied on the elongated element.

A further object of the present invention is the provision of equipment for laying an elongated element into a trench comprising advancing means and ways for the elongated element, characterized in that said ways carry devices for the active tensioning of the elongated element, which act in the direction opposite to the direction of advancement of the laying equipment, so that the portion of elongated element situated upstream of the equipment is subjected to a tension equal to, or higher than, the tension of the portion of elongated element situated downstream of said equipment.

In a preferred embodiment, said active tensioning devices comprise rollers. In a second preferred embodiment, said tensioning devices comprise driven tracks. In a third preferred embodiment, a part of the rollers or tracks is stationary, while the remaining part is movable. In a further preferred embodiment, the laying equipment comprises a locked-loop type control circuit which maintains the tension of the portion of elongated element situated upstream of the equipment at about a pre-established value or within a pre-established range of values.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

DETAILED DESCRIPTION OF THE INVENTION

Figure 1:
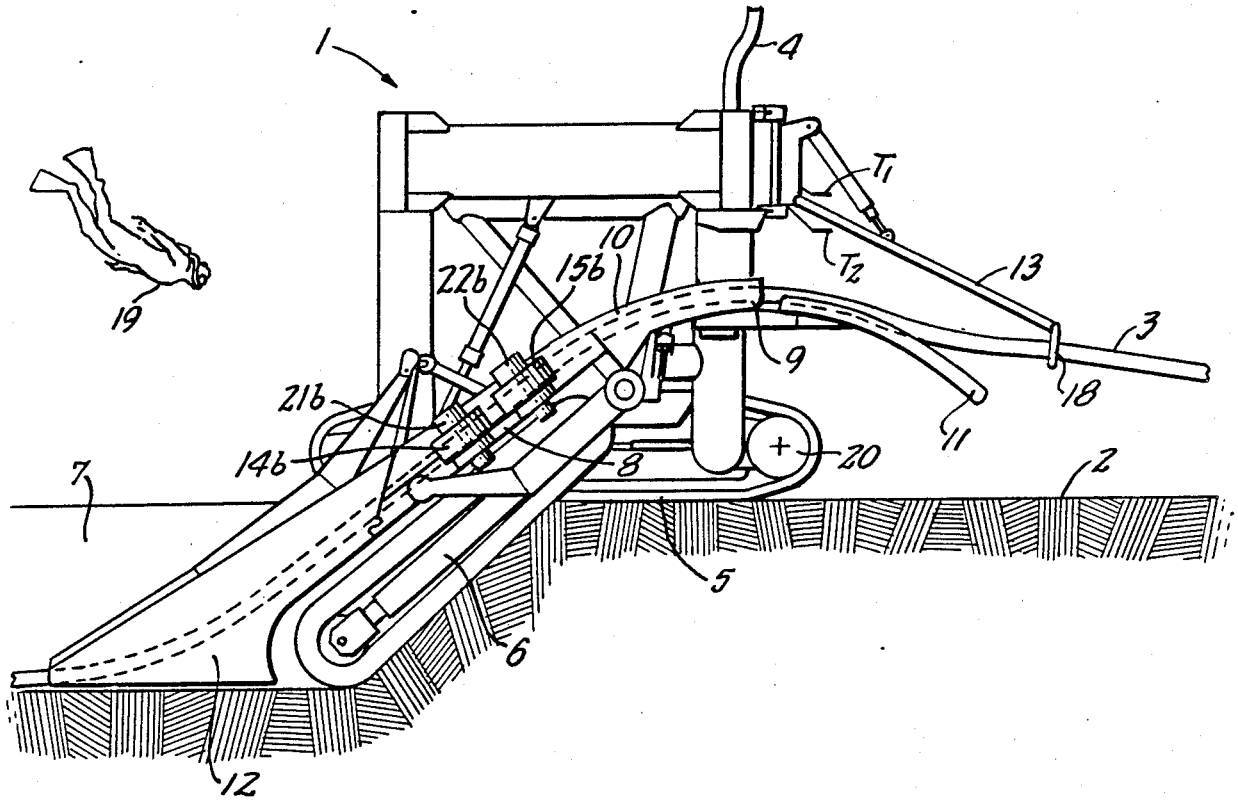
FIG. 1 illustrates a laying equipment in accordance with the present invention.

With reference to FIG. 1, a laying equipment 1 advances on a sea bed 2 to lay an elongated element 3 underground, the element 3 having been previously laid on said bed 2. The laying equipment 1 comprises an electric motor 20 fed by a cable 4 coming from the tender ship and hydraulic devices actuated by the electric motor 20.

Said hydraulic devices actuate—inter alia—locomotion means, such as tracks 5, for the advancement of the equipment, a power-shovel 6 for digging a trench 7 and a tensioning member 8 for the elongated element 3. In an alternative embodiment, the advancement of the laying equipment 1 can be carried out by a tow line from the tender ship.

Figure 2:
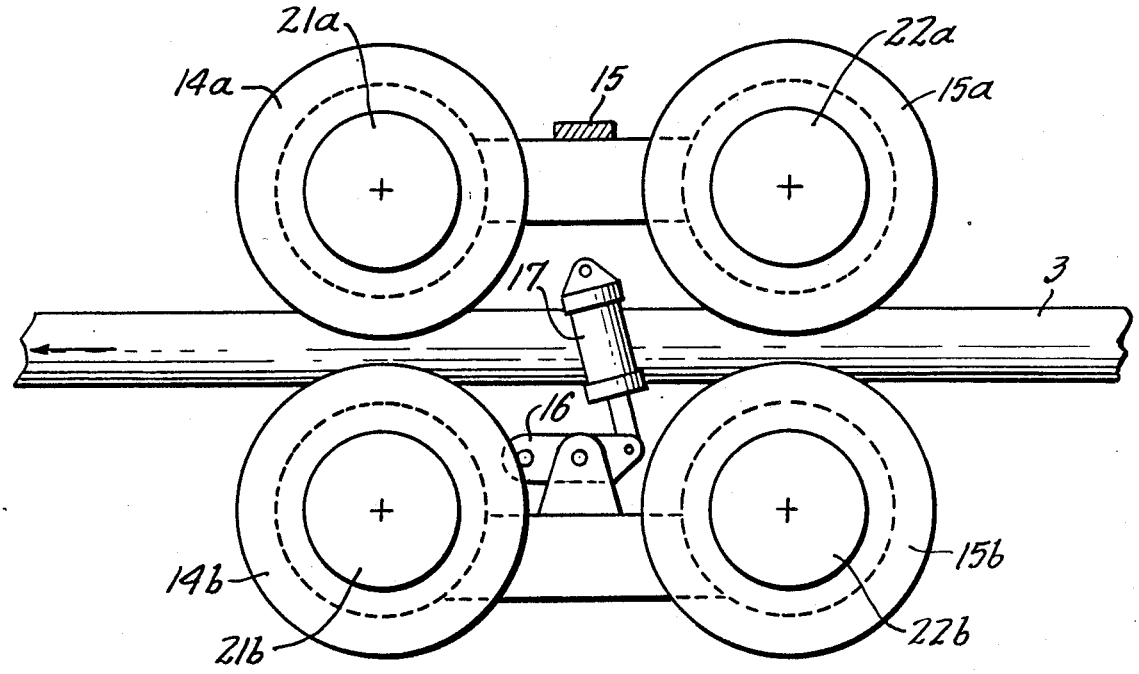
FIG. 2 is an enlarged plan view of a portion of the equipment shown in FIG. 1.

The tensioning member 8, which is more clearly illustrated in FIG. 2, is arranged in the central part 9 of ways 10 which comprise a front part 11 and a rear part 12. The front part of the equipment carries a moving arm 13 having at its end an openable ring 18 into which is inserted the elongated element 3 and which acts as a position sensor for the latter.

FIG. 2 shows the tensioning member 8 of FIG. 1 and comprises two pairs of motor-driven facing rollers 14*a*, 14*b* and 15*a*, 15*b* e.g. electric motor driven rollers. The driving can be individual for each roller by means of motors 21*a*, 21*b*, 22*a* and 22*b* or common to a pair of rollers. The rollers 14*a* and 15*a* are mounted on a fixed support 15, and the rollers 14*b* and 15*a* are mounted on a balance-type movable device 16 actuated by a jack 17.

Figure 3:
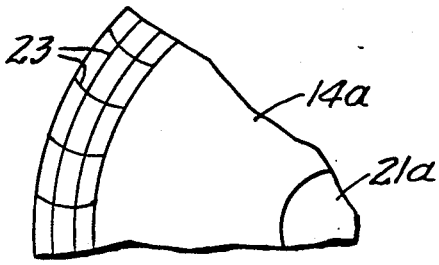
FIG. 3 is a fragmentary plan view of the roller 14*a* shown in FIG. 2.

The outer surfaces of all the four rollers 14*a*, 14*b*, 15*a*, 15*b* are concave and are provided with grooves or notches 23 (see FIG. 3). The rollers are made of high friction materials, such as rubber or resins having a high friction coefficient, in order to ensure a good grip on the elongated element 3 without damaging it.

Figure 4:
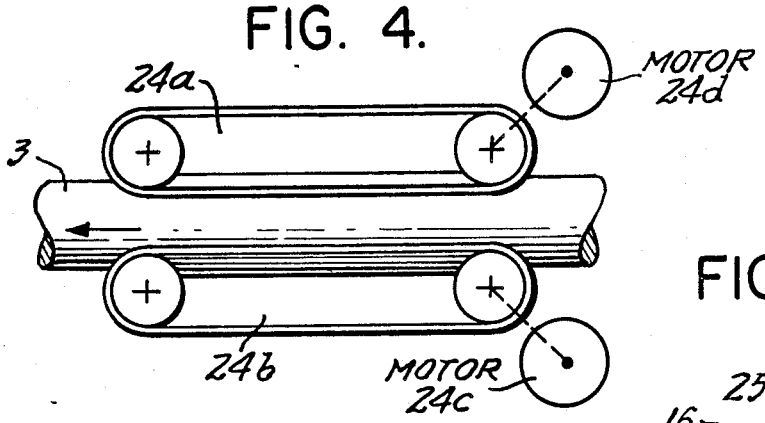
FIG. 4 is a plan view of tracks which may be substituted for the rollers shown in FIGS. 1 and 2.
Figure 5:
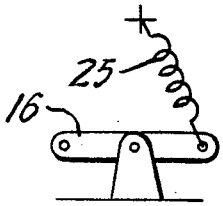
FIG. 5 is a plan view of an alternate balance type mounting for a pair of the rollers or one of the tracks shown in preceding FIGS.

In an alternative embodiment, the rollers 14*a*, 14*b*, 15*a* and 15*b* can be replaced by driven tracks 24*a* and 24*b* (see FIG. 4), still having concave facing surfaces and made of highly adherent material. In a second alternative embodiment, the gripping force exerted by the rollers or the tracks on the elongated element can be supplied by a spring 25 (see FIG. 5) rather than by the jack.

In operation, at first, a shallow-water diver 19 inserts the elongated element 3 in the laying equipment 1 and in particular in the openable ring 18 of the moving arm 13, into the portions 9, 11 and 12 of the ways 10 and between the pairs of rollers 14*a*, 14*b* and 15*a*, 15*b* of the tensioning member 8, and actuates jack 17 so that the pairs of rollers exert a gripping action on the elongated element 3.

As the laying equipment 1 advances (to the right as viewed in FIG. 1), the front part 11 of guide 10 lifts the elongated element 3, upstream of the equipment 1, the tensioning member 8 applies a tension force to said elongated element 3, the power-shovel 6 digs a trench 7 and the rear part 12 of the way 10 positions the elongated element 3 within said trench 7.

The tensioning member 8 applies an active tension to the elongated element 3 in the direction opposite to the direction of advance of the equipment 1. In this way, the portion of said elongated element upstream of the equipment is subjected to a tension equal to, or higher than, the tension on the downstream portion, so that a surplus of elongated element cannot accumulate upstream of the equipment 1.

The laying equipment 1 is also provided with a conventional, locked-loop type control circuit which keeps the portion of elongated element situated upstream of the equipment 1 under a constant tension at about a pre-established value or within a pre-established range of values. The control circuit comprises position transducers T1 and T2 (see FIGS. 1 and 6), for example, of a magnetic type and respectively arranged above and below the movable arm 13, which by means of a regulating circuit 30 controls the drive applied by the motors 21*a*, 21*b*, 22*a* and 22*b* of the tensioning member 8.

In operation, the movable arm 13 responds to the position, and therefore, the tension, to which the portion of elongated element 3 which is upstream of the laying equipment 1 is subjected, and the position transducers T1 and T2 convert this position into an electric signal, which, by means of the regulating circuit, determines the magnitude of the tension applied by the motors 21*a* etc. or 24*c* and 24*d* of the tensioning member 8 to the elongated element 3 through the dragging rollers 14*a* etc. or the tracks 24*a* and 24*b*.

Once the optimum tension to be applied to the portion of elongated element 3 situated upstream of the equipment 1, and consequently, the position of said portion, have been pre-established, the motors of the tensioning member 8 are actuated to generate a torque able to maintain such position.

If the position of the portion of elongated element 3 upstream of the equipment 1 becomes lower than the desired position, this means that the tension applied to said portion is smaller than the optimum tension, and therefore, the motors of the tensioning member 8 increase the tension applied to said elongated element 3 and bring the tension back to its pre-established value.

Conversely, if the position of the portion of elongated element upstream equipment 1 becomes higher than the desired position, this means that the tension applied to said portion is greater than the optimum tension, so that the motors of the tensioning member 8 reduce the tension applied on said elongated element 3, bringing the tension back to its pre-established value.

In this way, the tension applied by the tensioning member 8 to the elongated element 3 is continuously adjusted, according to the position of the portion of elongated element 3 situated upstream of the laying equipment 1, so that said regulation can be considered as analogue regulation.

Figure 7:
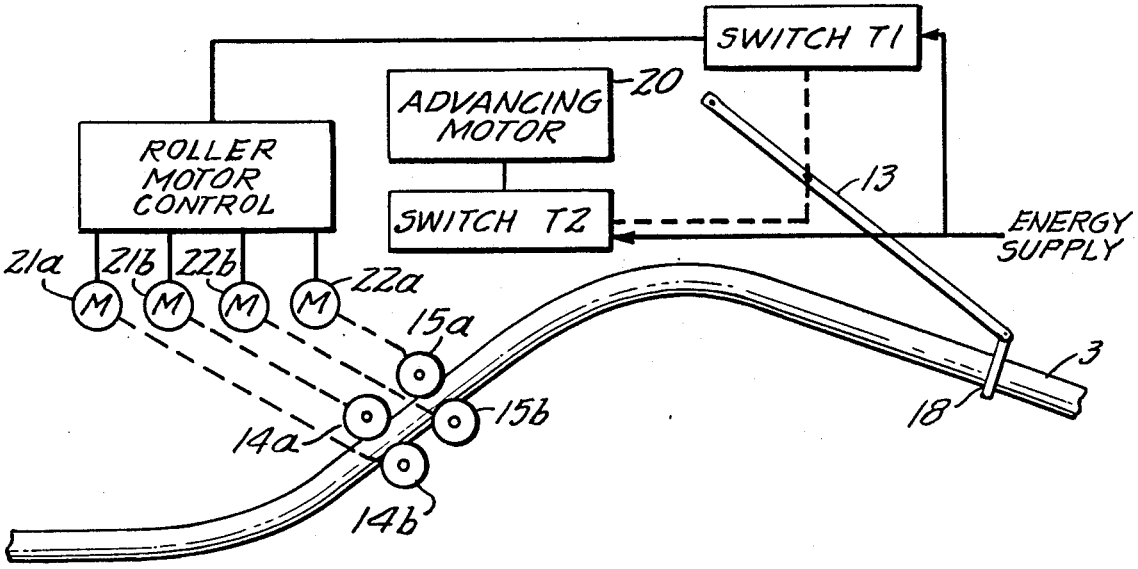

In an alternative embodiment, shown in FIG. 7, the position transducers T1 and T2 are switches which limit the minimum and maximum position permissible for the portion of elongated element 3 situated upstream of the equipment 1. Also, the magnitude of the tension applied by the tensioning member 8 to said elongated element 3 is not varied.

The upper switch T1 merely turns the motors of the tensioning member 8 on and off, and the lower switch T2 merely turns the motor 20 for advancing the laying equipment 1 on and off. When the movable arm 13 closes the lower switch T2, this means that the portion of elongated element 3 upstream of the equipment 1 is in excess and begins to accumulate. The actuators of said switch T2 stops the forward motion of equipment 1, and the tensioning member 8 transfers the accumulated length from upstream to downstream of said equipment 1.

When all the surplus has been transferred downstream, the portion of elongated element upstream the equipment is stretched within the pre-established limits, the movable arm 13 rises, the lower switch T2 returns to its unactuated state and the equipment 1 again begins to advance.

When the movable arm 13 actuates the upper switch T1, this means that the portion of elongated element 3 upstream of the equipment 1 is too stretched and the actuation of said switch T1 stops the motors of the tensioning member 8, leaving the rollers or the tracks gripping the elongated element. Therefore, the tensioning member 8 does not continue to apply tension to the elongated element 3 but the laying equipment 1 continues to advance.

When the tension of the portion of elongated element 3 situated upstream the laying equipment 1 has decreased to its pre-established limits, the element 34 lowers together with the moving arm 13 which returns the upper switch T1 to its unactuated position and re-starts the motors of the tensioning member 8, which reapplies an active tension to the elongated element 3.

In both of the described solutions, the amount of the tension or the distance between the position transducers or the switches which may be suitable to prevent the accumulation of surplus, are selected as a function of the characteristics of the elongated elements to be laid underground.

Figure 6:
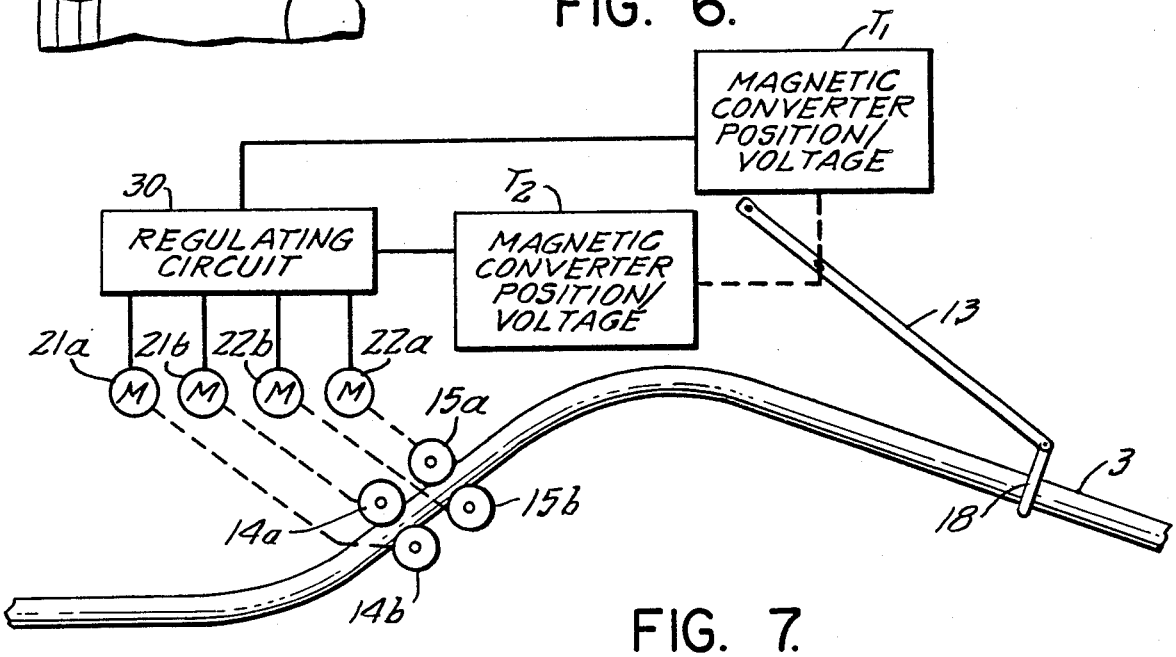
FIGS. 6 and 7 are diagrams of two forms of controls for the motors of the element tensioning device.

Although the controls illustrated in FIGS. 6 and 7 have been shown as controlling the motors for the rollers 14*a*, 14*b*, 15*a* and 15*b*, it will be apparent that such controls may also be used to control the motors 24*c* and 24*d* which drive the tracks 24*b* and 24*a* instead of the motors for the rollers.

From the foregoing description, it is evident that the invention achieves the goal of avoiding, during the laying of the elongated element underground, the accumulation of the element 3 upstream of the laying equipment. In fact, the tensioning member 8 applies to said elongated element an active tension able to overcome the resistance to the advancement thereof due to the friction generated during the passage of the elongated element along the ways of the laying equipment.

Furthermore, the control circuit of the locked-loop type ensures that the portion of elongated element upstream the laying equipment is always subjected to an optimum tension thereby preventing any damage either to the elongated element itself or to the laying equipment.

Also, the balance-type of mounting device for a pair of the rollers 14*b* and 15*a* or one of the tracks 24*a* and 24*b*, allows a certain independent movement of the rollers or tracks, so that, if there are enlargements on the elongated element 3, they can pass through the tensioning member without any risk of being subjected to excessive squeezing.

The method and equipment of the present invention have been described with reference to the laying underground of a sea bed of elongated elements where intervention by a human is very difficult, but it is evident that they can be used also for laying such elements underground of a surface which is not below water, thereby providing a greater mechanization of the laying operation.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. In the laying of an elongated element in a trench in the ground, which element has previously been laid on the ground, with apparatus which advances in a predetermined direction and which forms said trench, lifts said element from the ground at the upstream side of the apparatus and then deposits said element in said trench at the downstream side of the apparatus, said apparatus having ways for receiving and slidably engaging said element in its passage from the upstream side of said apparatus to the downstream side thereof, whereby a first portion of said element at and downstream of said apparatus is subjected to a first tension force in the direction of advance of said apparatus due to the friction between said ways and said element and to the resistance to movement of the portion of said element deposited in said trench and a second portion of said element upstream of said apparatus is subjected to second tension force in the opposite direction at the upstream side of said ways due to the weight of the lifted portion of said element upstream of said apparatus and to the resistance to movement of the portion of said element upstream of said apparatus, the method of at least partially offsetting any difference between said first tension forced applied to said elongated element in the first-mentioned said direction and said second tension applied to said element in said opposite direction which comprises engaging said element intermediate said upstream side and said downstream side of said apparatus and applying a third tension force to said element in the direction opposite to the direction of advance of said apparatus at least equal to said first tension force.

2. A laying method as set forth in claim 1 wherein said third tension force applied to said elongated element is controlled in a continuous manner so that said second tension force is substantially equal to a pre-established value, and so that when the tension on said second portion upstream of said apparatus is lower than said pre-established value, said third tension force is increased and when the tension on said second portion upstream of said apparatus is higher than said pre-established value, said third tension force is reduced.

3. A laying method as set forth in claim 1 wherein the tension on said second portion of said elongated element disposed upstream of said laying apparatus is maintained between pre-established minimum and maximum values.

4. A laying method as set forth in claim 3 wherein the advance of said laying apparatus is stopped when the tension on said second portion of said elongated element disposed upstream said apparatus is lower than said pre-established minimum value.

5. A laying method as set forth in claim 3 wherein said third tension force is discontinued when the tension on said second portion of said elongated element disposed upstream of the laying apparatus is higher than said pre-established maximum value.

6. In apparatus for laying into a trench an elongated element which has previously been laid on the ground, said apparatus comprising advancing means for advancing said apparatus in a predetermined direction, lifting means at the upstream side of said apparatus for lifting said element and ways for receiving and slidably engaging said elongated element as said element passes from the upstream side to the downstream side of said apparatus, whereby a first portion of said element at and downstream of said apparatus is subjected to a first tension force in the direction of advance of said apparatus due to the friction between said ways and said element and to the resistance to movement of the portion of said element deposited in said trench and a second portion of said element upstream of said apparatus is subjected to second tension force in the opposite direction at the upstream side of said ways due to the weight of the lifted portion of said element upstream of said apparatus and to the resistance to movement of the portion of said element upstream of said apparatus, the improvement comprising variable tensioning means at said ways engageable with said elongated element for applying a tension force to said element acting in the direction opposite to the direction of advancement of the laying apparatus which subjects the second portion of said elongated element disposed upstream of said apparatus to a variable tension force dependent upon and at least equal to the first tension force on the first portion of said elongated element disposed downstream of said apparatus. said elongated element disposed upstream of the laying apparatus is higher than said pre-established maximum value.

7. Laying apparatus as set forth in claim 6 wherein said tensioning means comprises at least one pair of facing rollers for engaging said element and motor means for driving said rollers.

8. Laying apparatus as set forth in claim 6 wherein said tensioning means comprises at least one pair of facing tracks and motor means for driving said tracks.

9. Laying apparatus as set forth in claim 7 wherein the facing surfaces of said rollers are concave for partially surrounding said element and are provided with notches.

10. Laying apparatus as set forth in claim 7 wherein the facing surfaces of said rollers are made of an elastomeric material having a high friction coefficient.

11. Laying apparatus as set forth in claim 8 wherein the facing surfaces of said tracks ar made of an elastomeric material having a high friction coefficient.

12. Laying apparatus as set forth in claim 7 wherein one of said pair of rollers is mounted from a fixed support whereas the other of said pair of rollers is mounted from a mounting device which is movable toward an elongated element between said pair of rollers.

13. Laying apparatus as set forth in claim 12 further comprising a jack connected to said mounting device for moving the latter toward an elongated element.

14. Laying apparatus as set forth in claim 12 further comprising spring means connected to said mounting device for urging the latter toward an elongated element.

15. Laying apparatus as set forth in claim 6 wherein said tensioning means comprises two pairs of facing rollers, one of the two pairs of rollers facing the other of the pairs of rollers for receiving an elongated element between said one pair of rollers and said other pair of rollers, motor means for driving at least two of said rollers and a mounting device on which one of said two pairs of rollers is mounted, said mounting device being of the balance type and urging the last-mentioned said one of said two pairs of rollers toward an elongated element between the pairs of rollers.

16. Laying apparatus as set forth in claim 6 further comprising detecting means upstream of said apparatus for detecting the position of an elongated element in advance of said ways and wherein said tensioning means is controlled by said detecting means for applying said tension force in an amount within a predetermined range.

17. Laying apparatus as set forth in claim 16 wherein said detecting means comprises a movable arm on said apparatus and engageable with a portion of said elongated element upstream of said apparatus.

18. Laying apparatus as set forth in claim 17 wherein said detecting means further comprises a pair of transducers operable by said arm, one of said pair of transducers being operable by said arm when the tension force on said elongated element causes said portion thereof to rise by at least a predetermined amount above a predetermined position and the other of said pair of transducers being operable by said arm when the tension force on said elongated element causes said portion thereof to lower by at least a predetermined amount below said predetermined position and wherein said tensioning means comprises drivable means engageable with said elongated element and motor means for driving said drivable means, at least one of said pair of transducers being connected to said motor means for controlling the movement of said drivable means.

19. Laying apparatus as set forth in claim 18 wherein both of said transducers are connected to said motor means through regulating means which varies the torque of said motor means in accordance with the position of said arm, said one of said pair of transducers, when operated, decreasing said torque and said other of said pair of transducers, when operated, increasing said torque.

20. Laying apparatus as set forth in claim 18 wherein said one of said pair of transducers is a first switch and said other of said pair of transducers is a second switch and wherein said second switch is connected to said advancing means for deenergizing said advancing means and wherein said first switch is connected to said motor means for deenergizing said motor means.

* * * * *

UNITED STATES PATENT AND TRADEMARK OFFICE

CERTIFICATE OF CORRECTION

PATENT NO. : 4,927,294

DATED : May 22, 1990

INVENTOR(S) : Magnani et al

It is certified that error appears in the above-identified patent and that said Letters Patent is hereby corrected as shown below:

Col. 7, line 10, cancel "said elongated element disposed up-"

Col. 7, cancel lines 11 and 12

Col. 7, line 28, "ar" should read --are--.

Signed and Sealed this

Thirtieth Day of July, 1991

*Attest:*

*Attesting Officer*

HARRY F. MANBECK, JR.

*Commissioner of Patents and Trademarks*